US009250555B1

(12) United States Patent
Terai et al.

(10) Patent No.: US 9,250,555 B1
(45) Date of Patent: Feb. 2, 2016

(54) CHARGING ROLL, PROCESS CARTRIDGE, AND IMAGE FORMING APPARATUS

(71) Applicant: FUJI XEROX CO., LTD., Tokyo (JP)

(72) Inventors: Yuji Terai, Kanagawa (JP); Yohei Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/601,856

(22) Filed: Jan. 21, 2015

(30) Foreign Application Priority Data

Aug. 25, 2014 (JP) ..... 2014-170883

(51) Int. Cl.
*G03G 15/02* (2006.01)

(52) U.S. Cl.
CPC ..... *G03G 15/0233* (2013.01)

(58) Field of Classification Search
CPC ..... G03G 15/0208; G03G 15/0233; G03G 15/0258; G03G 2215/025
See application file for complete search history.

(56) References Cited

U.S. PATENT DOCUMENTS

| | | | | |
|---|---|---|---|---|
| 5,377,432 | A | 1/1995 | Kishi | |
| 2002/0058193 | A1 * | 5/2002 | Tosaka et al. | 430/108.23 |
| 2007/0104504 | A1 * | 5/2007 | Terai et al. | 399/100 |
| 2007/0253739 | A1 | 11/2007 | Kagawa | |

FOREIGN PATENT DOCUMENTS

| | | | |
|---|---|---|---|
| JP | H06-136780 | A | 5/1994 |
| JP | H06-202440 | A | 7/1994 |
| JP | 2002-049215 | A | 2/2002 |
| JP | 2007-298775 | A | 11/2007 |

* cited by examiner

*Primary Examiner* — Gregory H Curran
(74) *Attorney, Agent, or Firm* — Oliff PLC

(57) ABSTRACT

Provided is a charging roll, including a core body, and an elastic layer that is disposed on an outer circumferential surface of the core body, wherein, with respect to an approximation curve that extends an outer curve of the axial direction of the core body of an outer circumferential surface in a region other than both end portions of the outermost layer up to both end portions of the outermost layer, a maximum increase amount of the outer curve in both end portions of the outermost layer is equal to or less than 60 μm, and wherein a coefficient of friction of the outer circumferential surface at a position showing the maximum increase amount of the outer curve in both end portions of the outermost layer is equal to or less than 0.3, and a variation amount of the coefficient of friction is equal to or less than 30%.

10 Claims, 7 Drawing Sheets

CHARGING ROLL, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-170883 filed Aug. 25, 2014.

BACKGROUND

Technical Field

The present invention relates to a charging roll, a process cartridge, and an image forming apparatus.

SUMMARY

According to an aspect of the invention, there is provided a charging roll, including:

a core body in a cylindrical shape or in a columnar shape; and an elastic layer that is disposed on an outer circumferential surface of the core body in a cylindrical shape, wherein, when measuring an outer shape of an outermost layer along an axial direction of the core body, with respect to an approximation curve that extends an outer curve of the axial direction of the core body of an outer circumferential surface in a region other than both end portions of the outermost layer up to both end portions of the outermost layer, a maximum increase amount of the outer curve in both end portions of the outermost layer is equal to or less than 60 μm, and wherein a coefficient of friction of the outer circumferential surface at a position showing the maximum increase amount of the outer curve in both end portions of the outermost layer is equal to or less than 0.3, and a variation amount of the coefficient of friction in a circumferential direction is equal to or less than 30%.

BRIEF DESCRIPTION OF THE DRAWINGS

Exemplary embodiments of the present invention will be described in detail based on the following figures, wherein.

DETAILED DESCRIPTION

Figure 1:
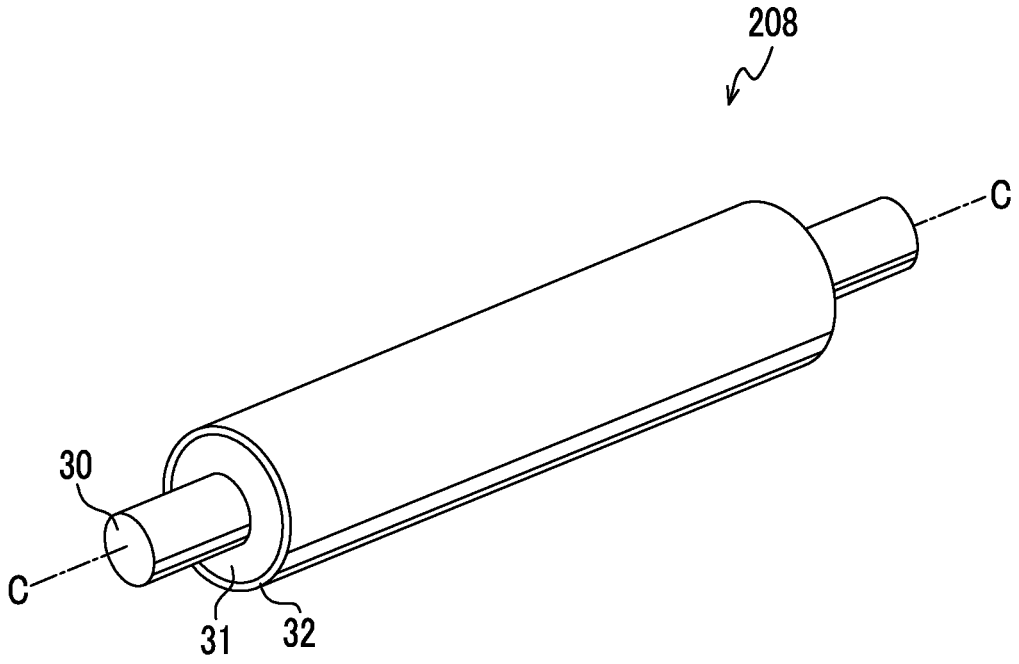
FIG. 1 is a schematic perspective view illustrating an example of a configuration of a charging roll according to an exemplary embodiment.

An example of a charging roll, a charging device, a process cartridge and an image forming apparatus according to an exemplary embodiment of the present invention will be described in detail.

Charging Roll

The charging roll according to the exemplary embodiment at least includes a core body in a cylindrical shape or in a columnar shape and an elastic layer which is disposed on an outer circumferential surface of the core body in a cylindrical shape. When measuring an outer shape of an outermost layer along an axial direction of the core body, with respect to an approximation curve which extends an outer curve of the axial direction of the core body of an outer circumferential surface in a region other than both end portions of the outermost layer up to both end portions of the outermost layer, a maximum increase amount of the outer curve in both end portions of the outermost layer is equal to or less than 60 μm, the coefficient of friction of the outer circumferential surface at a position showing the maximum increase amount of the outer curve in both end portions of the outermost layer is equal to or less than 0.3, and a variation amount of the coefficient of friction in a circumferential direction is equal to or less than 30%.

In general, the charging roll is used by being supported by a bearing in which both end portions of the core body are made of resin, being pushed to an image holding member by using a spring, and rotating with respect to the image holding member in a driven manner. Since both end portions of the charging roll are supported and pressed to the image holding member, the core body is bent. In order to correct a bending amount, for example, a uniformity of a contact portion between the charging roll and the image holding member is ensured by making the elastic layer have a crown shape.

The charging roll originally rotates in a driven manner with respect to the image holding member. However, there is a case where the charging roll may be used for a long period of time because of recently improved durability, a foreign matter is incorporated into a bearing portion of the charging roll according to the long period of use, and rotation of the charging roll may be interrupted. Furthermore, in recent years, there has been a case where the charging roll is equipped with a charging roll cleaning member which rotates in a driven manner with respect to the charging roll which has a roll shape. Similarly to the case of a charging roll, in a case where the rotation is interrupted by the bearing portion of the charging roll cleaning member, the rotation of the charging roll is interrupted by the charging roll cleaning member. As a result the rotation of the charging roll in a driven manner with respect to the rotation of the image holding member is interrupted, and the charging roll rotates with a circumferential speed difference.

When the charging roll rotates with a circumferential speed difference (circumferential speed of the charging roll<circumferential speed of the image holding member) with respect to the image holding member, a shearing force operates in a rotation direction in the charging roll. In this case, when there is a shape change in which an outer diameter increases at a part which has strong contact pressure, that is, at an end portion, or when there is an unevenness in the coefficient of friction in the rotation direction caused by a coverage state of a front surface layer and the coefficient of friction changes, a stronger shearing force operates. As a result, the shearing force exceeds a fracturing strength of the elastic layer, and the front surface layer or the elastic layer is damaged.

As described above, it is assumed that the end portion of the outermost layer is damaged because the charging roll has the circumferential speed difference with respect to the image holding member, and the charging roll does not rotate in a driven manner and receives the shearing force in the rotation direction in the contact portion between the image holding member and the charging roll. As a method for suppressing occurrence of a fracture in the end portion of the outermost layer, for example, a countermeasure to improve an strength of the elastic layer is considered. However, in order to obtain a characteristic value which is required for the charging roll, it is not preferable to easily change characteristics of the elastic layer. It is preferable to obtain a charging roll of which the front surface layer is unlikely to be damaged even when a circumferential speed difference is generated between the image holding member and the charging roll without changing the intensity of the elastic layer.

As result of investigation conducted by the inventors regarding the charging roll in which the front surface layer is damaged, it is found that, by employing a shape which decreases the contact pressure in the end portion to which the highest force is applied in the contact portion which is formed by the image holding member and the charging roll, the occurrence of a fracture is suppressed in the end portion, but a change in the coefficient of friction in the rotation direction of the charging roll in the end portion further contributes to occurring a fracture of the front surface layer. By suppressing the increase amount of a diameter and a variation amount of the coefficient of friction in the end portion, for example, even when the circumferential speed of the charging roll decreases to approximately 30% with respect to the image holding member, it is found that a fracture of the elastic layer is unlikely to be generated. In other words, according to the exemplary embodiment, without changing the intensity of the elastic layer, even in a case where the rotation of the charging roll is interrupted when using the roller for a long period of time, it is possible to obtain a charging roll in which a fracture of the elastic layer is unlikely to be generated.

In addition, in the charging roll according to the exemplary embodiment, both end portions of the outermost layer means a region within 50 mm in the axial direction of the core body from each end portion of the outermost layer, and a region other than both end portions means a region of a center part except the region within 50 mm in the axial direction of the core body from each end surface of the outermost layer.

FIG. 1 illustrates an example of a configuration of the charging roll according to the exemplary embodiment. A charging roll 208 illustrated in FIG. 1 is configured to have a core body 30 which has a cylindrical shape or a columnar shape, an elastic layer 31 which is disposed on the outer circumferential surface other than both end portions of the core body 30, and a front surface layer 32 which is disposed on the outer circumferential surface of the elastic layer 31. The core body 30 and the elastic layer 31 are adhered to each other by an adhesive layer (not illustrated).

When the outer shape of the front surface layer 32 which is the outermost layer along the axial direction of the core body 30 is measured, with respect to the approximation curve which extends the outer curve of the axial direction of the core body of the outer circumferential surface in the region other than both end portions of the front surface layer 32 up to both end portions of the front surface layer 32, the charging roll 208 according to the exemplary embodiment has a configuration in which the maximum increase amount (there is a case where the maximum increase amount is termed as a "maximum end portion increase amount") of the outer curve in both end portions of the front surface layer 32 is equal to or less than 60 μm, the coefficient of friction of the outer circumferential surface at the position showing the maximum increase amount of the outer curve in both end portions of the front surface layer 32 is equal to or less than 0.3, and the variation amount of the coefficient of friction in the circumferential direction is equal to or less than 30%.

Maximum End Portion Increase Amount

With respect to the approximation curve which extends the outer curve of the axial direction of the core body of the outer circumferential surface in the region other than both end portions of the outermost layer up to both end portions of the outermost layer, the charging roll according to the exemplary embodiment has a maximum increase amount (maximum end portion increase amount) of the outer curve in both end portions of the outermost layer which is equal to or less than 60 μm. From the viewpoint of suppressing occurrence of a fracture in the end portion of the outermost layer, it is preferable that the maximum end portion increase amount be equal to or less than 40 μm, and it is more preferable that the maximum end portion increase amount be equal to or less than 30 μm.

The maximum end portion increase amount is obtained as described below.

First, the outer shape of the front surface layer 32 along the axial direction of the core body 30 is measured. Specifically, in each region which is divided up in the circumferential direction by dividing the front surface layer 32 with a regular interval into 20 in the circumferential direction, that is, by dividing with an interval of 360°/20=18°, along the axial direction illustrated in FIG. 2, a distance from an axis C to the outer circumferential surface of the front surface layer 32 is measured, and the outer shape (outer diameter) of the front surface layer 32 is measured. Here, the outer shape of the front surface layer 32 is measured by using a Roll2000 manufactured by Asaka Riken Co., Ltd.

Figure 3:
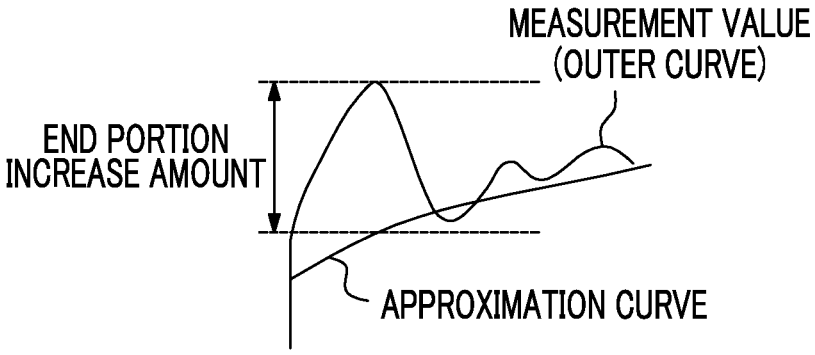
FIG. 3 is a view illustrating an end portion increase amount by enlarging an end portion which is surrounded by X in FIG. 2.

The approximation curve of the front surface layer 32 in the axial direction is obtained by approximating the outer curve as a quadratic curve in a region other than both end portions of the front surface layer 32, specifically, in a center region excluding 50 mm in the axial direction from each end portion of the front surface layer 32, and by extending the outer curve up to both end portions of the front surface layer 32. As illustrated in FIG. 3, with respect to the approximation curve, the maximum increase amount (end portion increase amount) of the outer curve in both end portions of the front surface layer 32 is obtained. In each region obtained by dividing by 20 in the circumferential direction, the outer shape along the axial direction is measured as described above, the end portion increase amount is obtained from each obtained approximation curve, and a maximum value of the end portion increase amount in both end portions is a "maximum end portion increase amount".

Coefficient of Friction of End Portion

The charging roll according to the exemplary embodiment has a coefficient of friction of the outer circumferential surface at a position showing the maximum increase amount of the outer curve in both end portions of the outermost layer which is equal to or less than 0.3, and a variation amount of the coefficient of friction in the circumferential direction which is equal to or less than 30%. From the viewpoint that rotation in a driven manner with respect to the image holding member is ensured, and occurrence of a fracture in the end portion of the outermost layer is suppressed, it is preferable that the above-described coefficient of friction be equal to or less than 0.2.

In addition, it is preferable that the variation amount of the coefficient of friction in the circumferential direction be equal to or less than 20%.

The coefficient of friction of the circumferential surface at the position showing the maximum increase amount of the outer curve in both end portions of the outermost layer, specifically, the coefficient of friction of the outer circumferential surface at the positions showing the maximum increase amount of the outer curve in each end portion (region within 50 mm from each end surface) of the front surface layer 32 which is the outermost layer, is measured in the circumferential direction by using a TRIBOGEAR TYPE: HHS2000 of Shinto Scientific Co., Ltd.

A state where the coefficient of friction of the outer circumferential surface at the position showing the maximum increase amount of the outer curve in both end portions of the outermost layer is equal to or less than 0.3 means that the coefficient of friction across the entire end portions when the coefficient of friction is measured along the circumferential direction in both end portions of the front surface layer 32 does not exceeds 0.3. A state where the variation amount of the coefficient of friction in the circumferential direction is equal to or less than 30% means that the maximum value and the minimum value of the coefficient of friction measured along the circumferential direction at the position showing the maximum increase amount of the outer curve is a range within ±30% or less of an average value.

Next, each configuration member of the charging roll 208 according to the exemplary embodiment will be described in detail.

Core Body

The core body 30 functions as an electrode and as a supporting member of the charging roll. Examples of materials of the core body 30 include: a metal or an alloy, such as iron (free-cutting steel or the like), copper, brass, stainless steel, aluminum, or nickel; chromium- or nickel-plated iron; or a conductive material, such as a conductive resin.

Examples of the core body 30 also include a member (for example, a resin or a ceramic member) which is a conductive rod-shaped member and of which the outer circumferential surface is plated, or a member (for example, a resin or a ceramic member) in which a conducting agent is dispersed.

The core body 30 may be a hollow-shaped member (tubular member), and may be a non-hollow-shaped member.

Elastic Layer

The elastic layer 31 is disposed in a cylindrical shape (roll shape) on the outer circumferential surface of the core body 30.

The elastic layer 31 is configured to have, for example, an elastic member, a conducting agent, and as necessary, other additives.

As elastic materials, it is preferable to use isoprene rubber, chloroprene rubber, epichlorohydrin rubber, isobutylene-isoprene rubber, polyurethane, silicone rubber, fluororubber, styrene butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene ternary copolymer rubber (EPDM), or acrylonitrile-butadiene copolymer rubber (NBR), natural rubber, and blend rubber using these types of rubber. Among these, it is preferable to use polyurethane, silicone rubber, EPDM, epichlorohydrin-ethylene oxide copolymer rubber, epichlorohydrin-ethylene oxide-allyl glycidyl ether copolymer rubber, NBR, and the blend rubber using these types of rubber. These elastic materials may be foamed or may be non-foamed.

Examples of the conducting agent include an electron conducting agent and an ion conducting agent.

Examples of the electron conducting agent include carbon black powder, such as Ketjen black or acetylene black; thermally decomposed carbon or graphite; various types of conductive metal or alloys, such as aluminum, copper, nickel, or stainless steel; various types of conductive metal oxides, such as tin oxide, indium oxide, titanium oxide, a tin oxide-antimony oxide solid solution, or a tin oxide-indium oxide solid solution; and a material of which a surface made of an insulation material has undergone conductive processing.

Specifically, examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", or "Color Black FW2V", which are manufactured by Degussa Corporation, and "MONARCH 1000", "MONARCH 1300", "MONARCH 1400", "MOGUL-L", or "REGAL 400R", which are manufactured by Cabot Corporation.

Examples of the ion conducting agent include: perchlorates or chlorates, such as those of benzyltriethylammonium chloride, tetraethylammonium, or lauryltrimethylammonium; or perchlorates or chlorates, such as those of alkali metals or alkaline earth metals including lithium or magnesium.

One type of conducting agent may be used independently, and two or more types of conducting agent may be combined and used.

It is preferable that an average particle diameter of the conducting agent be from 1 nm to 200 nm. In addition, the average particle diameter is measured by observing the conducting agent with an electronic microscope, measuring diameters of 100 particles of the conducting agent, and calculating the average thereof.

The added amount of the conducting agent in the elastic layer 31 is not particularly limited. However, it is preferable that the added amount be in a range from 1 parts by weight to 30 parts by weight, with respect to 100 parts by weight of the elastic material in a case of the electron conducting agent. It is more preferable that the added amount be in a range from 15 parts by weight to 25 parts by weight.

Meanwhile, in a case of the ion conducting agent, it is preferable that there be 0.1 parts by weight to 5.0 parts by weight of the ion conducting agent, and it is more preferable that there be 0.5 parts by weight to 3.0 parts by weight of ion conducting agent, with respect to 100 parts by weight of the elastic material.

Examples of other additives which are mixed into the elastic layer 31 include a material which may be added to a known elastic layer, such as a softener, a plasticizer, a hardener, a vulcanizing agent, a vulcanization accelerator, an antioxidant, a surfactant, a coupling agent, or a filler (silica or calcium carbonate).

When forming the elastic layer 31, a mixing method or a mixing order of the conducting agent, the elastic material, and other components (each component, such as the vulcanizing agent or a foaming agent which is added as necessary) which constitute the elastic layer 31 is not particularly limited. However, as a general method, a method for mixing all the components with a tumbler or a V blender in advance, melting and mixing with an extruder, and extrusion-molding, may be employed. For example, after forming an unvulcanized rubber composition layer on the outer circumferential surface of the core body by using a rubber roller manufacturing device which will be described later, it is possible to form the elastic layer by causing a cross-linking reaction.

It is preferable that a thickness of the elastic layer be approximately from 1 mm to 10 mm, and it is more preferable that the thickness be approximately from 2 mm to 5 mm.

In addition, it is preferable that a volume resistivity of the elastic layer be from $10^3$ Ωcm to $10^{14}$ Ωcm.

Front Surface Layer

The front surface layer 32 is a layer which is arbitrarily provided for preventing contamination mainly by a toner or the like, and is formed so that particles are dispersed in a binder resin.

Examples of the binder resin which is used in the front surface layer 32 include a urethane resin, a polyester resin, a phenol resin, an acrylic resin, an epoxy resin, polyamide resin or a cellulose.

Particles contained in the front surface layer 32 are used in order to perform resistance control by using the conductive material, reduce a change in a resistance value of the front surface layer 32 due to environment, obtain stabilized charging characteristics, decrease the coefficient of friction between the image holding member and the front surface layer by controlling an unevenness of the front surface layer of the roller, and improve a wear resistance between the image holding member and the front surface. In addition, it is possible to use the additive in order to improve adhesiveness between a lower layer (for example, the elastic layer 31) and the front surface layer and control dispersion of the particles in the binder resin.

It is preferable that the conductive particles have a particle diameter which is equal to or less than 3 μm and a volume resistivity which is equal to or less than $10^9$ Ωcm. For example, it is possible to use particles which is made of a metal oxide, such as tin oxide, titanium oxide, or zinc oxide, an alloy of these metal oxides, or carbon black.

As other particles, it is possible to use particles, such as alumina particles, silica particles, fluorine-based particles, silicone-based particles, or polyamide-based particles. It is preferable that the particle diameter be from 3 μm to 10 μm.

Specifically, the conductive particles contained in the front surface layer 32 may influence the volume resistivity of the charging roll and may select types and content of the particles according to a target volume resistivity. In general, the conductive particles are mixed in a range from 2 parts by weight to 20 parts by weight, with respect to 100 parts by weight of the binder resin included in the front surface layer 32.

From the viewpoint of durability with respect to wear, it is preferable that a film thickness of the front surface layer 32 be from 0.01 μm to 1000 μm. Furthermore, it is more preferable that the film thickness be from 0.1 μm to 500 μm, and it is still more preferable that the film thickness be from 0.5 μm to 100 μm.

Manufacturing Method of Charging Roll

A manufacturing method of the charging roll 208 according to the exemplary embodiment is not limited. For example, as illustrated in FIG. 1, in a case where there is the front surface layer 32 as the outermost layer on the outer circumferential surface of the elastic layer 31, the elastic layer 31 and the front surface layer 32 may be formed so that, when the outer shape of the front surface layer 32 along the axial direction of the core body 30 is measured, with respect to the approximation curve which extends the outer curve of the axial direction of the core body 30 of the outer circumferential surface in the region other than both end portions of the front surface layer 32 to both end portions of the front surface layer 32, the maximum increase amount of the outer curve in both end portions of the front surface layer 32 is equal to or less than 60 μm, the coefficient of friction of the outer circumferential surface at the position showing the maximum increase amount of the outer curve in both end portions of the front surface layer 32 is equal to or less than 0.3, and the variation amount of the coefficient of friction in the circumferential direction is equal to or less than 30%.

Hereinafter, an example of the manufacturing method of the charging roll according to the exemplary embodiment will be described in detail, but not limited thereto.

Figure 4:
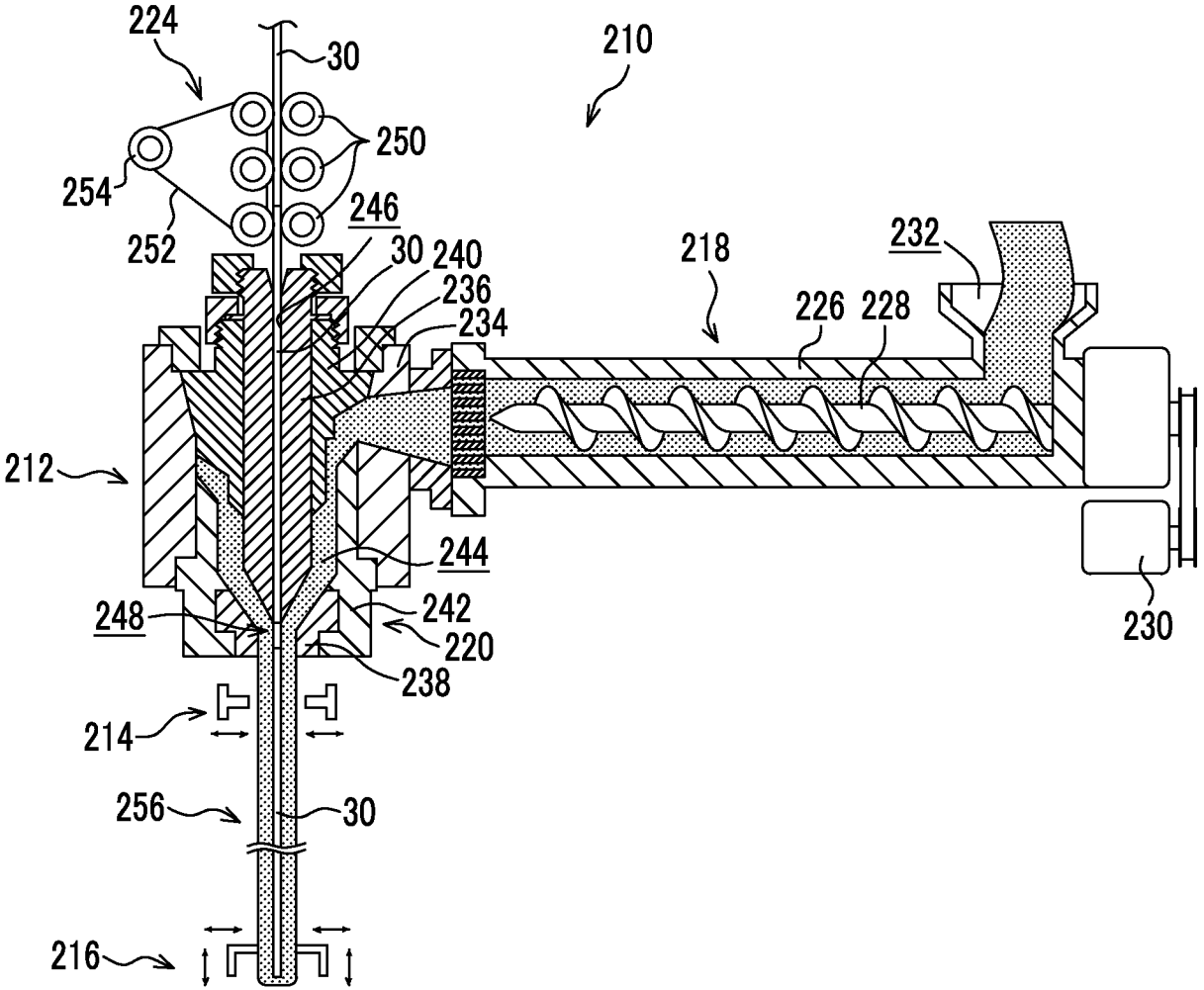
FIG. 4 is a schematic view illustrating an example of a configuration of an extrusion molding machine which is provided with a cross head.

FIG. 4 is a schematic view illustrating an example of a configuration of a rubber roller manufacturing device (the extrusion molding machine which is provided with a cross head) which is used in forming the elastic layer in the exemplary embodiment.

A rubber roller manufacturing device 210 according to the exemplary embodiment includes an exhauster 212 which is configured of the so-called cross head die, a pressurizer 214 which is disposed below the exhauster 212, and a drawing-out machine 216 which is disposed below the pressurizer 214.

The exhauster 212 includes a rubber material supply portion 218 which supplies an unvulcanized rubber material (rubber composition for forming the elastic layer), an extrusion portion 220 which extrudes the rubber material which is supplied from the rubber material supply portion 218 in a cylindrical shape (roll shape), and a core body supply portion 224 which supplies the core body 30 in which the adhesive layer is formed in a center portion of the rubber material which is extruded from the extrusion portion 220 in a cylindrical shape.

The rubber material supply portion 218 has a screw 228 inside a main body portion 226 which is in a cylindrical shape. The screw 228 rotates and is driven by a driving motor 230. An input port 232 to which the rubber material (rubber composition) is input is provided on the driving motor 230 side of the main body portion 226. The rubber material which is input from the input port 232 is sent out toward the extrusion portion 220 while being kneaded by the screw 228 inside the main body portion 226. By adjusting a rotation speed of the screw 228, a speed for sending out the rubber material is adjusted.

The extrusion portion 220 includes a cylindrical case 234 which is connected to the rubber material supply portion 218, a cylindrical mandrel 236 which is disposed in the center of the inside of the case 234, and an extracting head 238 which is disposed below the mandrel 236. The mandrel 236 is held in the case 234 by a holding member 240. The extracting head 238 is held in the case 234 by a holding member 242. Between an outer circumferential surface (outer circumferential surface of the holding member 240 at a part) of the mandrel 236 and an inner circumferential surface (inner circumferential surface of the extracting head 238 at a part) of the holding member 242, a circular flow path 244 in which the rubber material flows in a circular shape is formed.

An insertion hole 246 into which the core body 30 is inserted is formed in a center portion of the mandrel 236. A lower portion of the mandrel 236 has a shape which is tapered toward an end. A region below the tip end of the mandrel 236 is a merging region 248 where the core body 30 supplied from the insertion hole 246 and the rubber material supplied from the circular flow path 244 are merged. In other words, the rubber material is extruded toward the merging region 248 in a cylindrical shape, and the core body 30 is fed into the center portion of the rubber material which is extruded in the cylindrical shape.

The core body supply portion 224 includes a roller pair 250 which is disposed above the mandrel 236. Plural (three) roller pairs 250 are provided and the roller on one side of each roller pair 250 is connected to a driving roller 254 via a belt 252. When the driving roller 254 is driven, the core body 30 which is nipped by each roller pair 250 is sent toward the insertion hole 246 of the mandrel 236. As the core body 30 has a preset length, and the core body 30 on a rear side which is sent by the roller pair 250 pushes the core body 30 on a front side which exists in the insertion hole 246 of the mandrel 236, plural core bodies 30 passes through the insertion hole 246 in order. In addition, the driving of the driving roller 254 is stopped for now when a one front end of the other core body 30 is disposed at a tip end of the mandrel 236, in the merging region 248 below the mandrel 236, the core body 30 is fed with an interval.

In this manner, in the exhauster 212, the rubber material is extruded in a cylindrical shape in the merging region 248, and the core body 30 in which the adhesive layer is formed with an interval is fed into the center portion of the rubber material. Accordingly, the outer circumferential surface of the core body 30 is covered by the rubber material, and the unvulcanized rubber roller in which a rubber roller portion 256 (rubber composition layer) is formed on the outer circumferential surface of the core body 30 is obtained.

It is preferable that a thickness of the rubber composition layer be from 1 mm to 10 μm, and it is more preferable that the thickness be from 2 mm to 5 mm.

Next, as the extra rubber composition layer 256 in both end portions of the core body 30 is cut and removed, and the cross-linking reaction is generated by heating, the elastic layer 31 is formed. For example, in an air vulcanization furnace (hot air heating furnace), vulcanization is performed at 140° C. to 180° C. for 20 or more minutes and 300 or less minutes. Accordingly, the rubber roller portion 256 (rubber composition layer) is cross-linked, and the vulcanized rubber roller which has the elastic layer 31 is obtained on the adhesive layer.

Figure 5:
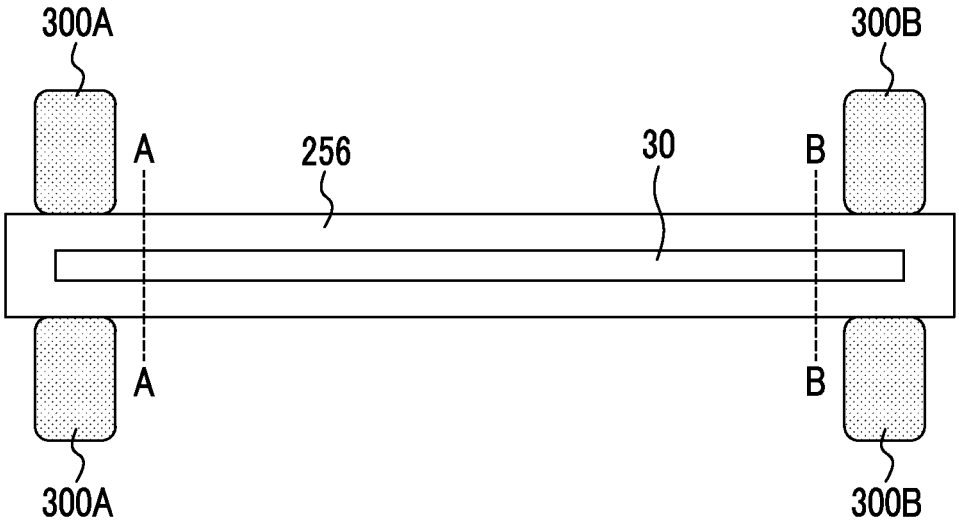
FIG. 5 is a schematic view illustrating an example of a position at which an elastic layer before vulcanization is held and cut.

Here, for example, as illustrated in FIG. 5, when the vicinity of both end portions of the unvulcanized rubber roller is grasped by grasping members 300A and 300B, and the rubber roller portion 256 is cut at a position of dotted lines A and B so that both end portions of the core body 30 are exposed, the rubber roller portion 256 is slightly recessed at a part grasped by the grasping members 300A and 300B, and as much as the rubber roller portion 256 is recessed, the rubber roller portion 256 is in a swollen shape on both sides of the grasped locations. In addition, it is easy to make a swollen shape even in a cut location. For this reason, after cutting, a part (hereinafter, there is a case where the part is called "end portion increase portion") in which the outer diameter increases in end portion of the elastic layer formed to be cross-linked is likely to remain. When forming the front surface layer on the outer circumferential surface of the elastic layer having the end portion increase portion in this manner, a shape of the end portion increase portion is likely to be reflected even in the shape of the front surface layer. For this reason, when the charging roll manufactured in this manner is in contact with the image holding member and charging is performed, compared to a region other than the end portion, a pressure with respect to the image holding member increases at the end portion, and a fracture is likely to occur by friction between the image holding member and the end portion of the front surface layer of the charging roll. In addition, friction between the image holding member and the end portion of the elastic layer increases when the elastic layer is the outermost layer without forming the front surface layer, and a fracture is likely to occur in the end portion.

Here, in the exemplary embodiment, it is preferable that the shape of the elastic layer 31 be adjusted so that the maximum increase amount of the outer curve in both end portions of the elastic layer 31 be equal to or less than 60 μm. A method for causing the maximum increase amount of the elastic layer 31 to be equal to or less than 60 μm is not particularly limited.

However, for example, a method for adjusting the shape by chamfering an edge portion of the elastic layer 31 after the cross-linking reaction, or a method for adjusting the shape by polishing the end portion, may be employed. In addition, in general, after forming the elastic layer 31, a chamfering process is performed. However, in the exemplary embodiment, when performing the chamfering process of the edge portion of the elastic layer, the shape is adjusted so that the maximum increase amount is equal to or less than 60 μm in the end portion by adjusting a chamfering shape and a chamfering amount. In addition, if a required discharging region is ensured, it is preferable that a region of a chamfering portion in the end portion of the elastic layer be as large as possible.

After forming the elastic layer 31, the front surface layer 32 is formed on the outer circumferential surface of the elastic layer 31. The front surface layer 32 is formed so that the coefficient of friction of the outer circumferential surface at the position showing the maximum increase amount of the outer curve in both end portions of the front surface layer 32 is equal to or less than 0.3 and the variation amount of the coefficient of friction in the circumferential direction is equal to or less than 30%.

Examples of a forming method of the front surface layer 32 include a forming method by a dipping method, a spraying method, a vacuum deposition method, or a plasma coating method on the elastic layer 31, by adjusting a dispersion liquid for forming the front surface layer which includes the resin, as necessary, the conducting agent, the particles for giving the front surface of the front surface layer an unevenness, and other additives in the solvent.

As described above, by adjusting the maximum increase amount in both end portions in forming the elastic layer 31 to be equal to or less than 60 μm, the end portion of the front surface layer 32 which is formed on the outer circumferential surface of the elastic layer 31 is reflected by the shape of the elastic layer 31, and it is possible to suppress the maximum end portion increase amount to be equal to or less than 60 μm.

Meanwhile, in forming the front surface layer 32, it is required that the coefficient of friction of the outer circumferential surface at the position showing the maximum increase amount of the outer curve in both end portions of the front surface layer 32 be equal to or less than 0.3, and the variation amount of the coefficient of friction in the circumferential direction be equal to or less than 30%. Examples of a method for adjusting the coefficient of friction in end portion of the front surface layer and the variation amount thereof include a method for adjusting the diameter and the content of the particles which are contained in coating liquid for forming the front surface layer which forms the front surface layer 32, and a method for performing the polishing process in the circumferential direction of the outer circumferential surface in both end portions of the front surface layer 32 after forming the front surface layer 32 on the outer circumferential surface of the elastic layer 31.

For example, it is possible to adjust the variation amount of the coefficient of friction in the circumferential direction to be equal to or less than 30% by enhancing a uniformity of dispersion of the particles in the front surface layer 32.

Charging Device

Figure 6:
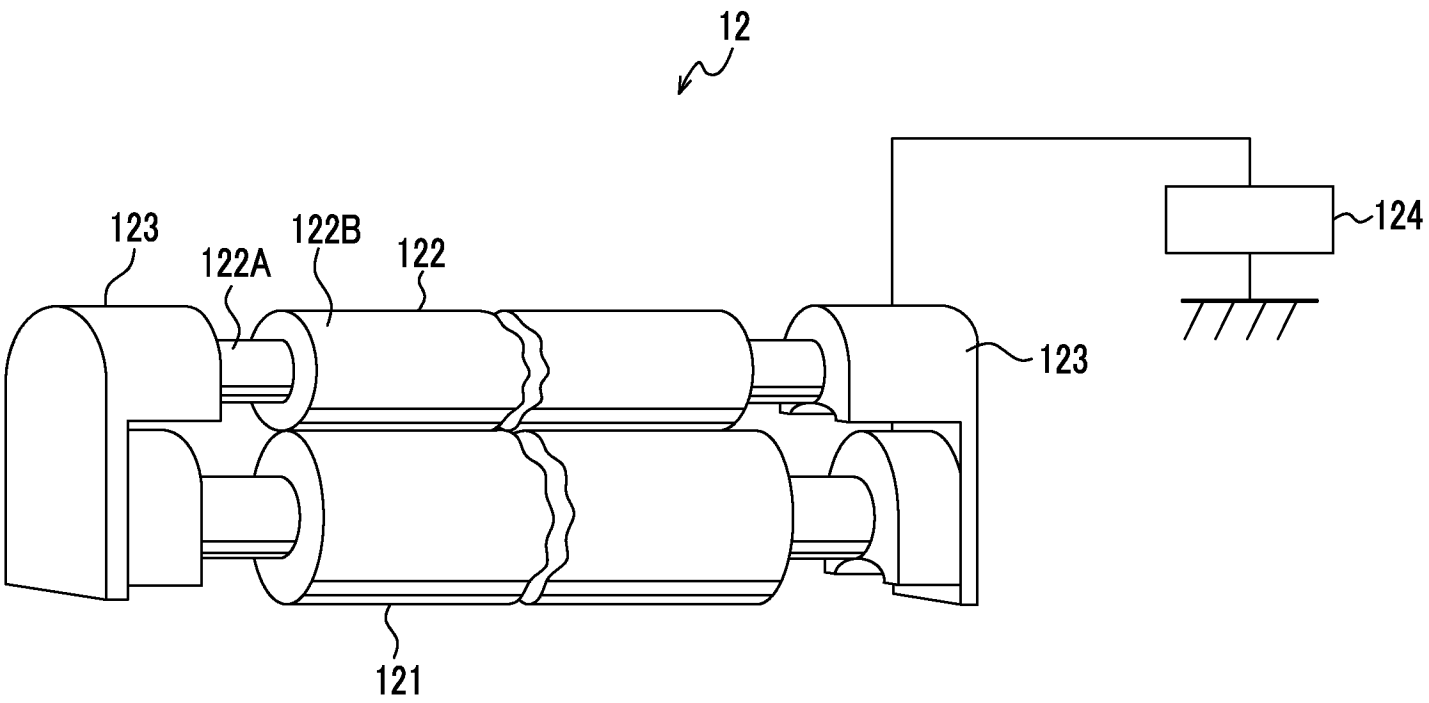
FIG. 6 is a schematic view illustrating an example of a configuration of a charging device according to the exemplary embodiment.

Next, a charging device according to the exemplary embodiment will be described. FIG. 6 is a schematic view illustrating an example of a charging device according to the exemplary embodiment.

The charging device according to the exemplary embodiment is in a state where the charging roll according to the above-described exemplary embodiment is employed.

Specifically, as described in FIG. 6, in a charging device 12 according to the exemplary embodiment, for example, a charging roll 121 and a cleaning member 122 are disposed to be in contact with each other with a certain interference. Both ends in the axial direction of the core body 30 of the charging roll 121 and a core body 122A of the cleaning member 122 are held by a conductive bearing 123 so that each member is free to rotate. A power source 124 is connected to one side of the conductive bearing 123.

The cleaning member 122 is a cleaning member for cleaning the front surface of the charging roll 121, for example, is configured in a roll shape. For example, the cleaning member 122 is configured of the core body 122A in a cylindrical shape or in a columnar shape and an elastic layer 122B on the outer circumferential surface of the core body 122A.

The core body 122A is a conductive rod-shaped member, and examples of a material of the core body 122A include metal, such as iron (free-cutting steel or the like), copper, brass, stainless steel, aluminum, or nickel. In addition, examples of the core body 122A include a member (for example, a resin or a ceramic member) which is plated on the outer circumferential surface, or a member (for example, a resin or a ceramic member) in which the conducting agent is dispersed. The core body 122A may be a hollow-shaped member (tubular member) or may be a non-hollow-shaped member.

The elastic layer 122B is made of foaming body having a three-dimensional porous structure, has a cavity or an unevenness portion (hereinafter, refer to as a cell) on the inside or the front surface thereof, and may be have elasticity. The elastic layer 122B is configured to include a foamable resin material or the rubber material, such as polyurethane, polyethylene, polyamide, olefin, melamine, or polypropylene, NBR (acrylonitrile-butadiene copolymer rubber), EPDM (ethylene-propylene-diene copolymer rubber), natural rubber, styrene-butadiene rubber, chloroprene, silicone, or nitrile.

Even among the foamable resin materials and the rubber materials, in order to efficiently clean a foreign matter, such as the toner or an external additive by coming into a sliding contact with the charging roll 121 in a driven manner, to make it difficult to cause a scratch by a scrape of the cleaning member 122 on the front surface of the charging roll 121, and to make it difficult to cause pieces or damage over a long period of time, polyurethane which has a strong tension or the like is appropriately employed.

Polyurethane is not particularly limited, and examples of polyurethane include a reactant, such as polyol (for example, polyester polyol, polyether polyol, or acrylic polyol), and isocyanate (2,4-tolylene diisocyanate, 2,6-tolylene diisocyanate, 4,4-diphenyl methane diisocyanate, tolidine diisocyanate, or 1,6-hexamethylenediisocyanate). Polyurethane may be a reactant by a chain extender (for example, 1,4-butanediol or trimethylolpropane) of these examples. In addition, polyurethane is generally foamed by using the foaming agent (water or an azo compound (azodicarbonamide or azobisisobutyronitrile)).

The conductive bearing 123 is a member which holds the charging roll 121 and the cleaning member 122 to be free to rotate as an integrated body, and which holds a center distance between the members. The conductive bearing 123 may be made of any material or may be in any state if the conductive bearing 123 is made of a material having a conductivity, and for example, a conductive bearing or a conductive sliding bearing may be employed.

The power source 124 is a device which charges the charging roll 121 and the cleaning member 122 to the identical polarity by applying a voltage to the conductive bearing 123, and a known high voltage power source device is used.

In the charging device 12 according to the exemplary embodiment, for example, by applying the voltage to the conductive bearing 123 from the power source 124, the charging roll 121 and the cleaning member 122 are charged to the identical polarity.

In addition, the charging device according to the exemplary embodiment is not limited to the above-described configuration, and for example, may be in a state where the cleaning member 122 is not provided.

Image Forming Apparatus

Next, an image forming apparatus according to the exemplary embodiment will be described.

The image forming apparatus according to the exemplary embodiment is configured to have the image holding member, a charging unit which has the charging roll according to the exemplary embodiment and charges the image holding member by bringing the charging roll into contact with the front surface of the image holding member, an electrostatic latent image forming unit which forms the electrostatic latent image on the front surface of the charged image holding member, a developing unit which develops the electrostatic latent image formed on the front surface of the image holding member and forms a toner image, by a developer including the toner, and a transferring unit which transfers the toner image to the front surface of the recording medium.

Figure 7:
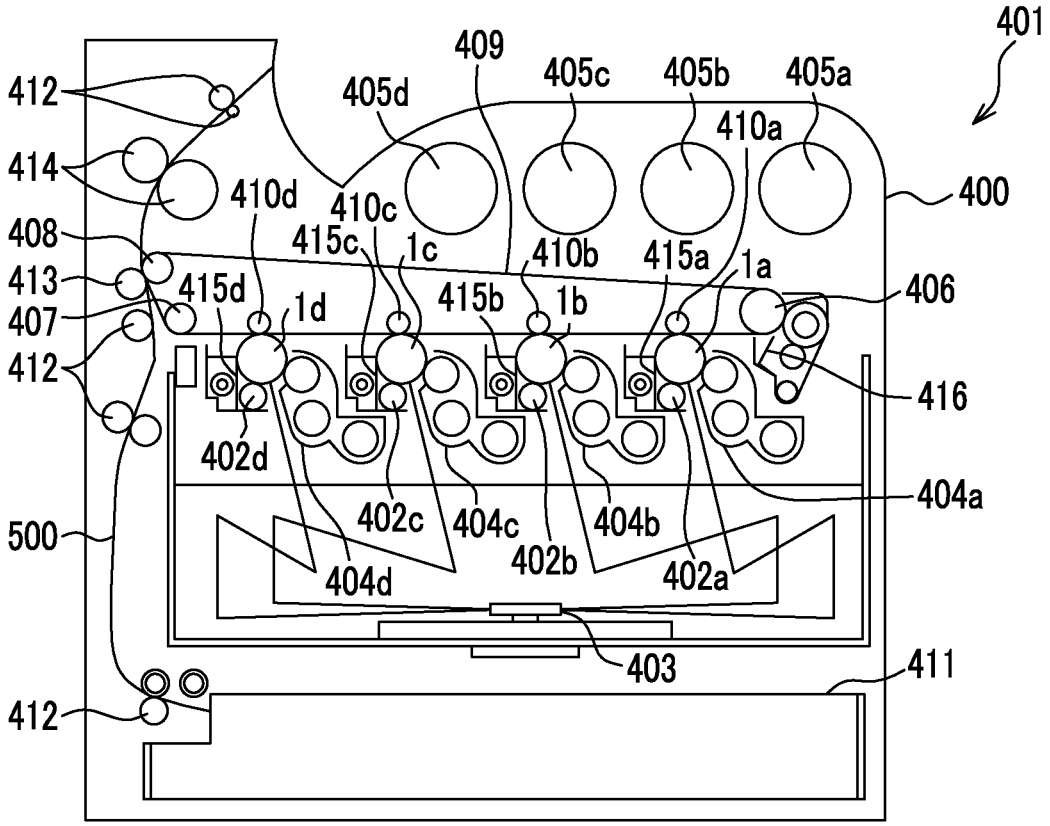
FIG. 7 is a schematic view illustrating an example of a configuration of an image forming apparatus according to the exemplary embodiment.

FIG. 7 is a schematic view illustrating an example of a basic configuration of the image forming apparatus according to the exemplary embodiment. An image forming apparatus 401 illustrated in FIG. 7 is an intermediate transfer type image forming apparatus, and four image holding members (electrophotographic photosensitive body) 1*a*, 1*b*, 1*c*, and 1*d* are disposed in parallel to each other along an intermediate transfer belt 409 in a housing 400. For example, the image holding member 1*a* forms a yellow image, the image holding member 1*b* forms a magenta image, the image holding member 1*c* forms a cyan image, and the image holding member 1*d* forms a black image, respectively.

Here, the image holding members 1*a*, 1*b*, 1*c*, and 1*d* which are mounted on the image forming apparatus 401 are respectively image holding members according to the exemplary embodiment.

The image holding members 1*a*, 1*b*, 1*c*, and 1*d* respectively rotate in one direction (counterclockwise on the paper), and along the rotation direction thereof, charging rolls 402*a*, 402*b*, 402*c*, and 402*d*, developing devices 404*a*, 404*b*, 404*c*, and 404*d*, primary transfer rollers 410*a*, 410*b*, 410*c*, and 410*d*, and cleaning blades 415*a*, 415*b*, 415*c*, and 415*d* are disposed. The charging rolls 402*a*, 402*b*, 402*c*, and 402*d* are respectively the above-described charging rolls according to the exemplary embodiment, and a contact charging method is employed.

The developing devices 404*a*, 404*b*, 404*c*, and 404*d* respectively supplies four colors of the toner, such as black, yellow, magenta, and cyan, accommodated in toner cartridges 405*a*, 405*b*, 405*c*, and 405*d*. In addition, the primary transfer rollers 410*a*, 410*b*, 410*c*, and 410*d* are respectively in contact with the image holding members 1*a*, 1*b*, 1*c*, and 1*d* via the intermediate transfer belt 409.

A laser light source (exposure device) 403 is disposed inside the housing 400, and front surfaces of the image holding members 1*a*, 1*b*, 1*c*, and 1*d* after being charged is irradiated with laser light emitted from the laser light source 403.

Accordingly, each process of charging, exposing, developing, primarily transferring, and cleaning (removing the foreign matter, such as the toner) is performed in order in rotation process of the image holding members 1*a*, 1*b*, 1*c*, and 1*d*, and each color of the toner images is transferred to be overlapped on the intermediate transfer belt 409. In the case of the image holding members 1*a*, 1*b*, 1*c*, and 1*d* after the toner image is transferred onto the intermediate transfer belt 409, next image forming process is performed without performing the process of removing an electric charge on the front surface.

The intermediate transfer belt 409 is supported to have a tension by a driving roller 406, a back surface roller 408, and a supporting roller 407, and rotates without generating a deflection by the rotation of these rollers. In addition, a secondary transfer roller 413 is disposed to come into contact with the back surface roller 408 via the intermediate transfer belt 409. The intermediate transfer belt 409 which passes through a position which is nipped between the back surface roller 408 and the secondary transfer roller 413 repeats the next image forming process after being cleaned by a cleaning blade 416 which is disposed facing the driving roller 406.

In addition, a container 411 which accommodates the recording medium is provided inside the housing 400. After a recording medium 500, such as a paper sheet in the container 411, is moved to a position which is nipped between the intermediate transfer belt 409 and the secondary transfer roller 413, and further moved to a position which is nipped between two fixing rolls 414 which are in contact with each other by a transporting roller 412, the recording medium 500 is extracted to the outside of the housing 400.

A case where the intermediate transfer belt 409 is used as an intermediate transfer body is described above. However, the intermediate transfer body may be in a belt shape like the above-described intermediate transfer belt 409, and may be in a drum shape. In a case of a belt shape, as a resin material which constitutes a base material of the intermediate transfer body, a known resin is used. For example, the resin material, such as a blend material including polyimide resin, a polycarbonate resin (PC), a polyvinylidene fluoride (PVDF), a polyalkylene terephthalate (PAT), ethylene tetrafluoroethylene copolymer (ETFE)/PC, ETFE/PAT, and PC/PAT, a polyester, a polyetheretherketone, or a polyamide, and the resin material which has these materials as a main raw material, may be employed. Furthermore, the resin material and an elastic material may be blended and used.

In addition, the recording medium according to the exemplary embodiment is not particularly limited if the recording medium is a medium which transfers the toner image formed on the image holding member.

Process Cartridge

A process cartridge of the exemplary embodiment includes the charging unit which has the charging roll according to the exemplary embodiment, brings the charging roll into contact with the front surface of the image holding member, and charges the image holding member. The process cartridge is configured to be attached to and detached from the image forming apparatus.

Figure 8:
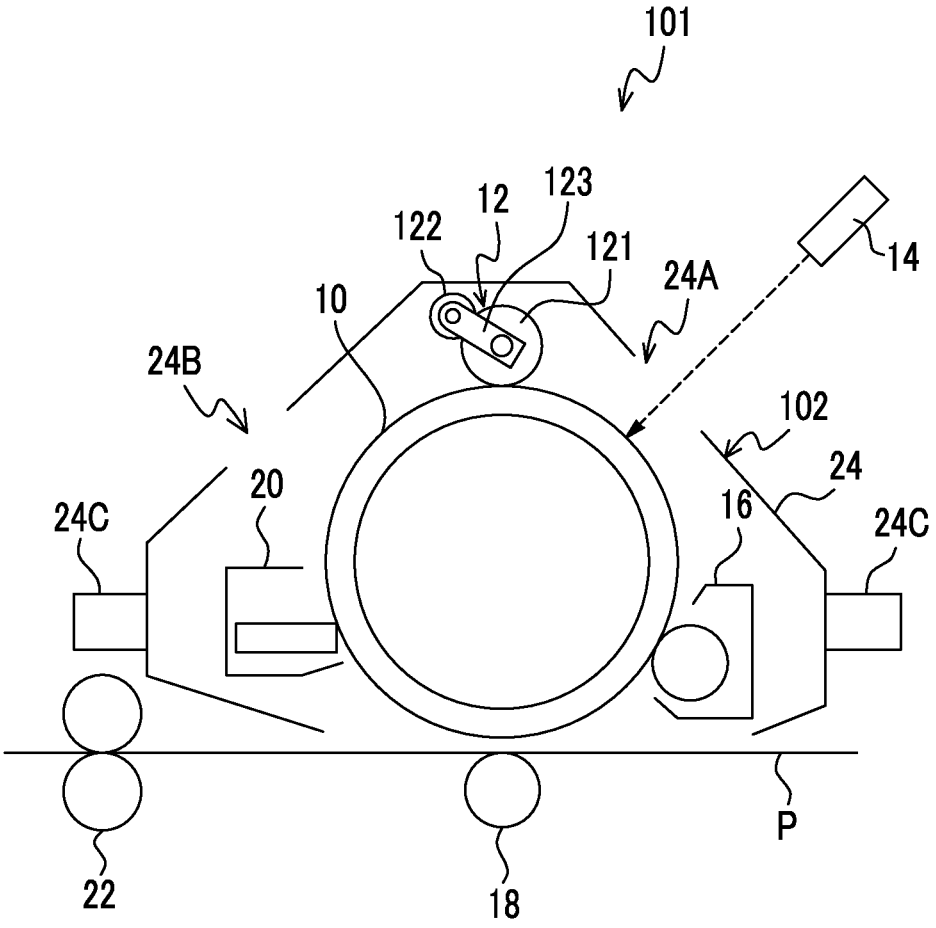
FIG. 8 is a schematic view illustrating an example of a configuration of a process cartridge according to the exemplary embodiment.

FIG. 8 is a schematic view illustrating an example of a basic configuration of the process cartridge according to the exemplary embodiment. As illustrated in FIG. 8, the process cartridge according to the exemplary embodiment is a process cartridge 102 which includes an image holding member (electrophotographic photosensitive body) 10 and the charging roll 121 according to the exemplary embodiment, in a case 24 which is provided with an opening portion 24A for exposure, an opening portion 24B for destaticizing exposure, and an attached rail 24C, and which is configured to hold the charging device 12 that brings the charging roll 121 into contact with the front surface of the image holding member 10 and charges the image holding member 10, a developing device 16 that develops a latent image formed by an exposure device 14 by the toner and forms the toner image, and a cleaning device 20 which removes residual toner on the front surface of the image holding member 10 after transferring, by combining these to be integrated. The process cartridge 102 is installed to be free to be attached to and detached from an image forming apparatus 101. In addition, the image forming apparatus 101 according to the exemplary embodiment is configured to have a fixing device 22 which fixes the toner image transferred to a recording medium P by a transferring device 18.

EXAMPLE

Hereinafter, the present invention will be described in more detail based on Examples and comparative examples, but the present invention is not limited to the following Examples.

Example 1

Making Charging Roll

Making Elastic Layer

After kneading a mixture (rubber composition) of a composition illustrated in Table 1 by a kneader, and molding by applying a conductive adhesive to the front surface of the core body which has 8 mm of diameter electrolessly nickel-plated to SUM 22 and forming a rubber composition layer on a surface of the conductive adhesive by using a cross head extruder of FIG. 4, vulcanization of the rubber composition layer using a press molding machine is performed, and the elastic layer in a roll shape having 13 mm of outer diameter is formed on the front surface of the core body.

The elastic layer which is formed on the front surface of the core body is cut by 17.5 mm of length in the axial direction of the core body from each end surface and removed. By chamfering the outer each edge portion on both end surfaces by C1.5 after cutting, and by polishing, the end portion increase amount in both end portions is adjusted to be equal to or less than 0.4 mm.

After this, the elastic layer having 12 mm of outer diameter is obtained by polishing.

TABLE 1

| Configuration material of elastic layer | Name of compound | Mixing amount (parts by weight) |
|---|---|---|
| Elastic layer | Epichlorohydrin rubber | 95.6 |
| | Nitrite butadiene rubber | 4.4 |
| Conducting agent | Benzyltriethylammonium chloride | 0.9 |
| | Carbon black | 15 |
| Vulcanizing agent | Sulfur | 0.5 |
| Vulcanization accelerator | Tetramethyl lithium disulfide | 1.5 |
| | Dibenzo thiasol disulfide | 1.5 |
| Filler | Calcium carbonate | 20 |
| Vulcanization accelerator | Stearic acid | 1 |

Making Front Surface Layer

By diluting a mixture of the following composition by methanol and dispersing the mixture by a bead mill, the dispersion liquid for forming the front surface layer is obtained.

Next, after performing dip coating of the dispersion liquid for forming the front surface layer on the front surface of the conductive elastic layer which is formed on the outer circumferential surface except both end portions of the core body, heat drying is performed for 30 minutes at 145° C., and the front surface layer having 10 μm of thickness is formed.

Solid Content Composition of Dispersion Liquid for Forming Front Surface Layer

Resin 100 parts by weight (N-methoxymethylated nylon: F30K, made by Nagase ChemteX Corporation)

Conductive particle (Conductive filler) 40 parts by weight (Nicabeads PC0520, made by Nippon Carbon Co., Ltd., volume average particle system: 6.7 μm, average roundness: 0.95)

Conducting agent 17 parts by weight (Carbon black MONAHRCH 1000, made by Cabot Corporation, volume average particle diameter: 43 nm)

Catalyst 4.4 parts by weight (NACURE4167, made by King Industries Inc.)

Measurement of Maximum End Portion Increase Amount

Figure 2:
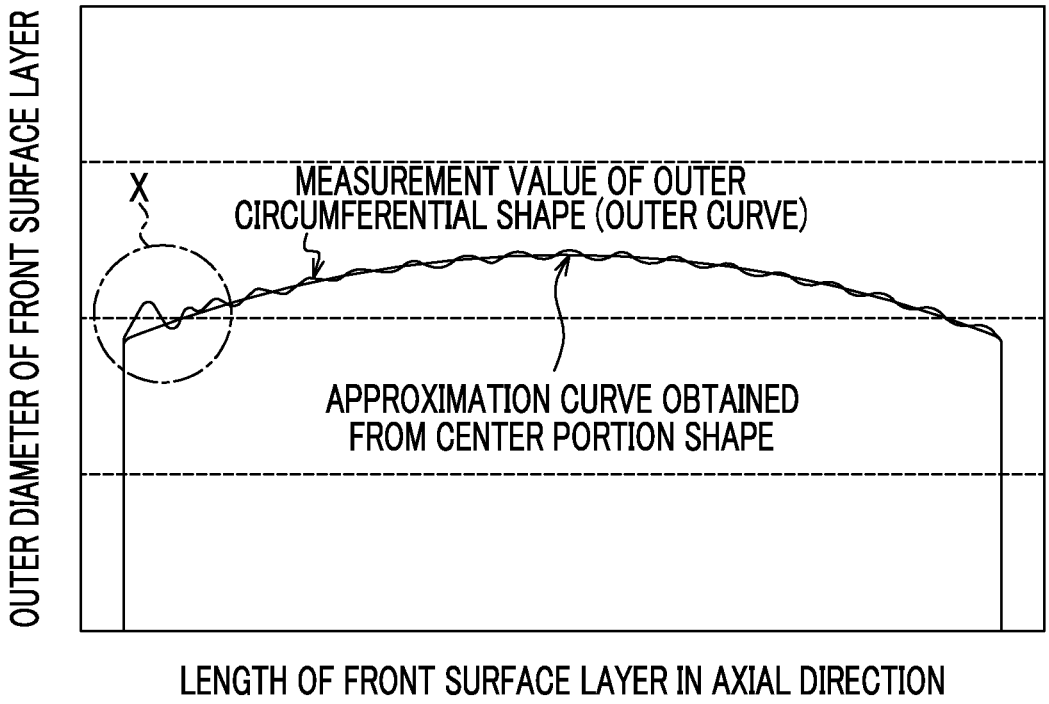
FIG. 2 is a view illustrating an example of an outer shape of a front surface layer and an approximation curve in an axial direction of a core body.

By dividing the outer circumferential surface of the front surface layer by 20 and using ROLL2000 made by Asaka Riken Co., Ltd., the outer shape (outer diameter) of the front surface layer along the axial direction in each region divided in the circumferential direction is measured. As illustrated in FIG. 2, the approximation curve (quadratic curve) which extends from the outer curve in the region excluded 50 nm from each end surface of the front surface layer in the axial direction up to both end portions of the front surface layer, is obtained. Next, in both end portions of the front surface layer, as illustrated in FIG. 3, an increase amount (end portion increase amount) of the outer curve with respect to the approximation curve, is obtained.

The end portion increase amount is obtained as described above in each region which is divided in the circumferential direction. A maximum value of the end portion increase amount in both end portions of the front surface layer is the "maximum end portion increase amount".

Measurement of Coefficient of Friction of End Portion

The coefficient of friction of the outer circumferential surface in both end portions of the front surface layer of the manufactured charging roll is measured by the following device and conditions. The coefficient of friction is measured across the entire circumferential direction by pressing a sapphire probe by applying weight to the position showing the maximum end portion increase amount of the end portion outer circumferential surface of the front surface layer of the charging roll and by rotating the charging roll.

Machine used: TRIBOGEAR TYPE: HHS2000 of Shinto Scientific Co., Ltd.

Measurement Condition

Charging roll: outer diameter ϕ 12 mm

Charging roll rotation speed: 1 rpm

Probe weight: 10 gf

Making Charging Roll Cleaning Member

Urethane foam is stuck to the core body which is nickel-plated by the SUM22 having ϕ 6 mm of outer diameter ϕ, by using a hot-melt adhesive. After this, by processing the outer diameter to have ϕ 10 mm by a grinding process, the charging roll cleaning member is made.

Evaluation

The charging roll and the charging roll cleaning member of Example 1 is combined with the process cartridge of DocuCentre IV C5575 made by Fuji Xerox Co., Ltd., a polyimide tape is adhered to a bearing part of the charging roll cleaning member, rotation of the charging roll cleaning member is interrupted, and as a result, the charging roll is put to stop. In this state, when the image holding member rotates at 255 mm/s of circumferential speed, the circumferential speed of the charging roll is adjusted to be approximately 30% (75 mm/s), and a continuous rotation test is performed for 20 minutes.

Examples 2 to 11, Comparative Examples 1 to 4

The elastic layer is formed similarly to Example 1 except that the maximum end portion increase amount is adjusted by chamfering after cutting both end portions and changing each condition of polishing, in making the elastic layer in Example 1.

Next, the front surface layer is made similarly to Example 1 except that the coefficient of friction is adjusted by changing the mixing amount of the conductive particles as illustrated in the following Table 2, in making the front surface layer in Example 1.

By using the charging roll made in each Example and each comparative example, the evaluation is performed by a similar method as that in Example 1.

Evaluation result is illustrated in Table 2.

TABLE 2

| | Mixing amount of conductive particles in front surface layer (resin 100 parts by weight) | Maximum end portion increase amount (μm) | Coefficient of friction of end portion (maximum value) | Variation amount in circumferential direction of coefficient of friction of end portion (%) | Generation of damage of end portion |
|---|---|---|---|---|---|
| Example 1 | 40 parts by weight | 40 | 0.27 | 30% | No |
| Example 2 | 40 parts by weight | 30 | 0.20 | 10% or less | No |
| Example 3 | 40 parts by weight | 20 | 0.20 | 10% or less | No |
| Example 4 | 40 parts by weight | 10 | 0.20 | 10% or less | No |
| Example 5 | 40 parts by weight | 5 | 0.20 | 10% or less | No |
| Example 6 | 10 parts by weight | 40 | 0.20 | 20% | No |
| Example 7 | 10 parts by weight | 30 | 0.20 | 10% or less | No |
| Example 8 | 10 parts by weight | 20 | 0.20 | 10% or less | No |
| Example 9 | 10 parts by weight | 10 | 0.20 | 10% or less | No |
| Example 10 | 10 parts by weight | 5 | 0.25 | 10% or less | No |
| Example 11 | 10 parts by weight | 60 | 0.22 | 10% or less | No |
| Comparative example 1 | 10 parts by weight | 30 | 0.27 | 40% | Yes |
| Comparative example 2 | 10 parts by weight | 20 | 0.27 | 40% | Yes |
| Comparative | 10 parts by weight | 80 | 0.22 | 10% or less | Yes |

TABLE 2-continued

| | Mixing amount of conductive particles in front surface layer (resin 100 parts by weight) | Maximum end portion increase amount (μm) | Coefficient of friction of end portion (maximum value) | Variation amount in circumferential direction of coefficient of friction of end portion (%) | Generation of damage of end portion |
|---|---|---|---|---|---|
| example 3 | | | | | |
| Comparative example 4 | 60 parts by weight | 40 | 0.32 | 50% | Yes |

Regardless of the coefficient of friction of the end portion of the front surface layer, when the end portion increase amount (maximum value) exceeds 60 μm, the elastic layer is damaged. In addition, even when the end portion increase amount is equal to or less than 60 μm, in a case where the variation amount of the coefficient of friction in the end portion circumferential direction exceeds 30%, it is confirmed that the front surface layer is damaged.

Meanwhile, if the end portion increase amount (maximum value) of the front surface layer is equal to or less than 60 μm, the coefficient of friction of the outer circumferential surface in both end portions of the outermost layer is equal to or less than 0.3, and the variation amount of the coefficient of friction in the circumferential direction is equal to or less than 30%, the front surface layer is not damaged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging roll, comprising:

a core body in a cylindrical shape or in a columnar shape; and an elastic layer that is disposed on an outer circumferential surface of the core body in a cylindrical shape, wherein, when measuring an outer shape of an outermost layer along an axial direction of the core body, with respect to an approximation curve that extends an outer curve of the axial direction of the core body of an outer circumferential surface in a region other than both end portions of the outermost layer up to both end portions of the outermost layer, a maximum increase amount of the outer curve in both end portions of the outermost layer is equal to or less than 60 μm, wherein a coefficient of friction of the outer circumferential surface at a position showing the maximum increase amount of the outer curve in both end portions of the outermost layer is equal to or less than 0.3, and a variation amount of the coefficient of friction in a circumferential direction is equal to or less than 30%, and wherein each of the end portions of the outermost layer is a region within 50 mm in the axial direction of the core body from each axial end of the outermost layer, and the region other than both end portions is a region of a center part except the regions within 50 mm in the axial direction of the core body from each axial end of the outermost layer.

2. The charging roll according to claim 1, wherein the maximum increase amount of the outer curve in both end portions of the outermost layer is equal to or less than 40 μm.

3. The charging roll according to claim 1, wherein the maximum increase amount of the outer curve in both end portions of the outermost layer is equal to or less than 30 μm.

4. The charging roll according to claim 1, wherein the coefficient of friction of the outer circumferential surface at the position showing the maximum increase amount of the outer curve in both end portions of the outermost layer is equal to or less than 0.2.

5. The charging roll according to claim 1, wherein a variation amount of the coefficient of friction in the circumferential direction is equal to or less than 20%.

6. The charging roll according to claim 1, further comprising:

a front surface layer that is disposed on the elastic layer as the outermost layer.

7. A process cartridge that is attached to and detached from an image forming apparatus, the process cartridge comprising:

the charging roll according to claim 1.

8. The process cartridge according to claim 7, further comprising:

a cleaning member that cleans the outer circumferential surface of the charging roll by coming into contact with the outer circumferential surface of the charging roll, and rotating according to rotation of the charging roll.

9. An image forming apparatus, comprising:

an image holding member;

a charging unit that includes the charging roll according to claim 1 and charges the image holding member by bringing the charging roll into contact with a front surface of the image holding member;

an electrostatic charge image forming unit that forms an electrostatic charge image on a front surface of the charged image holding member;

a developing unit that accommodates an electrostatic charge image developer and develops the electrostatic charge image formed on the front surface of the image holding member as a toner image, by using the electrostatic charge image developer, a transferring unit that transfers the toner image formed on the front surface of the image holding member to a front surface of a recording medium; and a fixing unit that fixes the toner image transferred to the front surface of the recording medium.

10. The image forming apparatus according to claim 9, further comprising:

a cleaning member that cleans an outer circumferential surface of the charging roll by coming into contact with the outer circumferential surface of the charging roll, and rotating according to rotation of the charging roll.

* * * * *